US011149524B2

(12) United States Patent
Reed et al.

(10) Patent No.: US 11,149,524 B2
(45) **Date of Patent: *Oct. 19, 2021**

(54) SAND FALL-BACK PREVENTION TOOL

(71) Applicant: Halliburton Energy Services, Inc., Houston, TX (US)

(72) Inventors: Stewart Darold Reed, Spring, TX (US); Justin Kyle York, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 42 days.

This patent is subject to a terminal disclaimer.

(21) Appl. No.: 16/325,359

(22) PCT Filed: Sep. 13, 2016

(86) PCT No.: PCT/US2016/051461

§ 371 (c)(1),
(2) Date: Feb. 13, 2019

(87) PCT Pub. No.: WO2018/052396

PCT Pub. Date: Mar. 22, 2018

(65) Prior Publication Data

US 2019/0203565 A1 Jul. 4, 2019

(51) Int. Cl.
*E21B 21/10* (2006.01)
*E21B 34/06* (2006.01)
(Continued)

(52) U.S. Cl.
CPC ..... *E21B 34/08* (2013.01); *E21B 21/103* (2013.01); *E21B 34/066* (2013.01); *E21B 43/128* (2013.01)

(58) Field of Classification Search
CPC ..... E21B 34/08; E21B 43/128; E21B 21/103; E21B 34/066
See application file for complete search history.

(56) References Cited

U.S. PATENT DOCUMENTS 3,967,679 A 7/1976 Liljestrand
4,817,739 A 4/1989 Jeter
(Continued)

FOREIGN PATENT DOCUMENTS

WO 2018052396 A1 3/2018
WO 2018052470 A1 3/2018
WO 2018052857 A1 3/2018

OTHER PUBLICATIONS

"SandRight Solids Fallback Preventer: Sand Management Tool"; Summit ESP, A Halliburton Service; 2019; 2 pages.
(Continued)

*Primary Examiner* — Daniel P Stephenson
(74) *Attorney, Agent, or Firm* — Locke Lord LLP

(57) ABSTRACT

A downhole tool comprises a housing defining a flow path therethrough in an axial direction from an upper opening to a lower opening. A poppet valve is mounted within the housing. The poppet valve includes an upper member defining an upper chamber mounted in the flow path so that flow through the flow path flows around the upper member, and a valve seat mounted in the flow path with an opening therethrough. A valve poppet is mounted for longitudinal movement within the flow path between a closed position in which the valve poppet seats against the valve seat to block flow through the flow path and an open position in which the valve poppet is spaced apart from the valve seat to permit flow through the flow path. This can restrict/mitigate sand fall-back, e.g., with flow paths designed to prevent/mitigate sand fall-back and for protection of the poppet from sand/debris.

18 Claims, 5 Drawing Sheets

(51) Int. Cl.
*E21B 34/08* (2006.01)
*E21B 43/12* (2006.01)

(56) References Cited

U.S. PATENT DOCUMENTS

| | | | | |
|---|---|---|---|---|
| 6,167,969 | B1 | 1/2001 | Schoeffler | |
| 6,289,990 | B1 * | 9/2001 | Dillon | E21B 34/08 166/319 |
| 6,543,532 | B2 | 4/2003 | Estep et al. | |
| 7,487,831 | B2 | 2/2009 | Pluchek et al. | |
| 8,545,190 | B2 * | 10/2013 | Osborne | E21B 34/08 417/53 |
| 10,132,151 | B2 * | 11/2018 | Leitch | E21B 43/128 |
| 10,132,152 | B2 * | 11/2018 | Leitch | E21B 27/005 |
| 10,337,323 | B2 * | 7/2019 | Kruger | E21B 23/00 |
| 10,584,571 | B2 * | 3/2020 | Leitch | E21B 43/121 |
| 2005/0121233 | A1 * | 6/2005 | Frith | E21B 21/002 175/57 |
| 2005/0230120 | A1 | 10/2005 | Victor | |
| 2013/0264069 | A1 | 10/2013 | Williamson, Jr. | |
| 2013/0299181 | A1 | 11/2013 | Coyle et al. | |
| 2013/0299200 | A1 | 11/2013 | Hughes et al. | |
| 2014/0014358 | A1 | 1/2014 | Leitch | |
| 2015/0300136 | A1 | 10/2015 | Jefferies et al. | |
| 2019/0203565 | A1 * | 7/2019 | Reed | E21B 34/08 |
| 2019/0271210 | A1 * | 9/2019 | Reed | E21B 34/08 |

OTHER PUBLICATIONS

International Search Report, issued in PCT/US2017/051031, dated Dec. 22, 2017.

International Search Report issued in PCT/US2017/012025, dated Jun. 2, 2017.

International Search Report issued in PCT/US2016/051461 dated May 10, 2017.

* cited by examiner

SAND FALL-BACK PREVENTION TOOL

CROSS REFERENCE TO RELATED APPLICATIONS

This application is the national phase under 35 U.S.C. § 371 of PCT International Application No. PCT/US2016/051461, filed Sep. 13, 2016. The entire content of which is incorporated by reference herein.

BACKGROUND OF THE INVENTION

1. Field of the Invention

The present disclosure relates to downhole tools, and more particularly to tools for reduction of inoperability and/or damage of electrical submersible pumps due to solid particle (e.g., formation sand, proppant, and the like) fall back such as used in oil and gas wells.

2. Description of Related Art

Natural formation sands and/or hydraulic fracturing proppant (referred to herein as sand) in subterranean oil and gas wells can cause significant problems for electrical submersible pumps (ESPs). Once sand is produced through the ESP it must pass through the tubing string prior to reaching the surface. Sand particles often hover or resist further downstream movement in the fluid stream above the ESP or move at a much slower velocity than the well fluid due to physical and hydrodynamic effects. When the ESP is unpowered, fluid and anything else in the tubing string above the pump begins to flow back through the pump. Check valves are often used to prevent flow back while also maintaining a static fluid column in the production tubing. However check valves are subject to failures caused by solids including sand.

Such conventional methods and systems have generally been considered satisfactory for their intended purpose. However, there is still a need in the art for improved sand fall-back prevention/mitigation tools that protect the operability and reliability of ESPs. The present disclosure provides a solution for this need.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
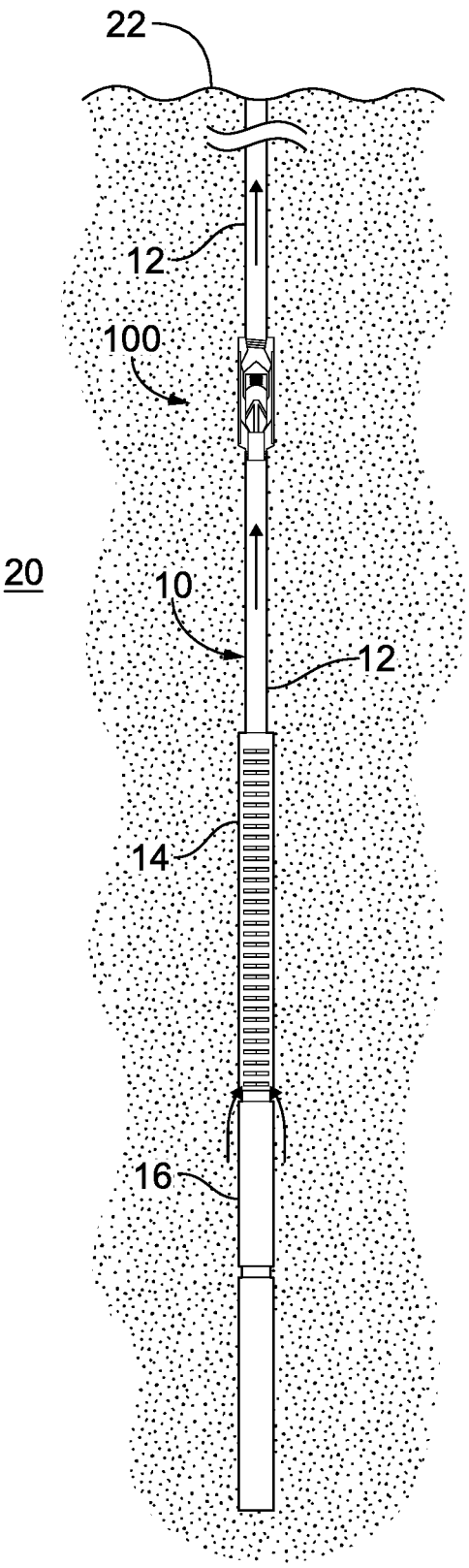
FIG. 1 is a schematic side elevation view of an exemplary embodiment of a downhole tool constructed in accordance with the present disclosure, showing the downhole tool in a string that includes a motor and electrical submersible pump (ESP), wherein the string is in a formation for production of well fluids that may contain any combination of water, hydrocarbons, and minerals that naturally occur in oil and gas producing wells.

Reference will now be made to the drawings wherein like reference numerals identify similar structural features or aspects of the subject disclosure. For purposes of explanation and illustration, and not limitation, a partial view of an exemplary embodiment of a downhole tool in accordance with the disclosure is shown in FIG. 1 and is designated generally by reference character 100. Other embodiments of downhole tools in accordance with the disclosure, or aspects thereof, are provided in FIGS. 2-8, as will be described. The systems and methods described herein can be used to mitigate, reduce or prevent fall-back sand reaching an electrical submersible pumps (ESP) in downhole operations such as in oil, gas, and/or water producing wells.

Figure 2:
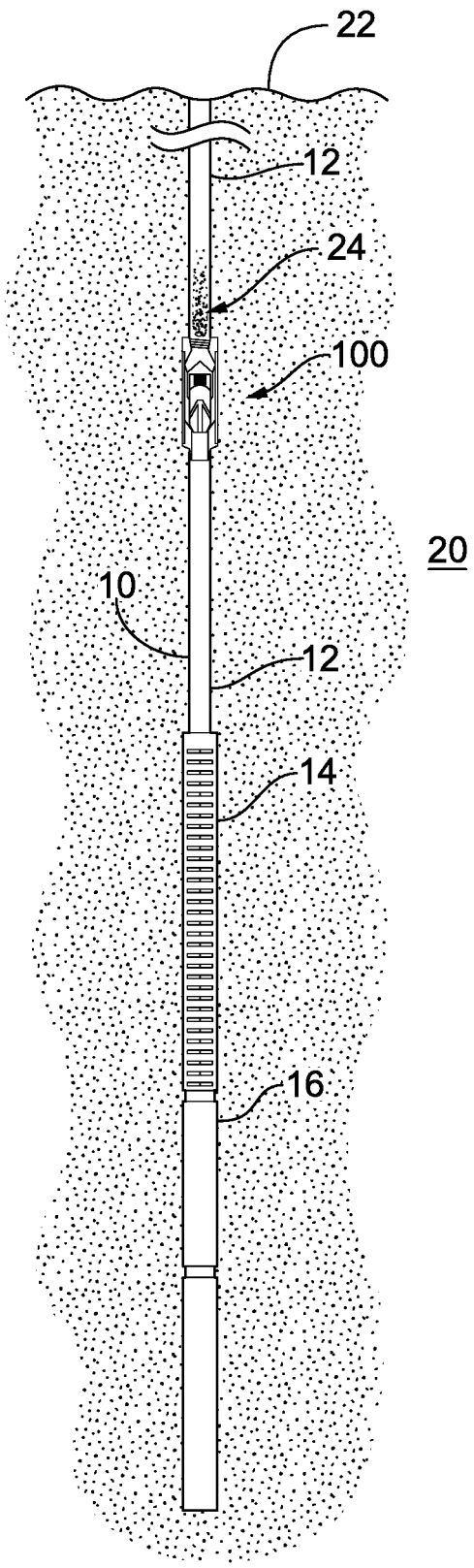
FIG. 2 is a schematic side elevation view of the downhole tool of FIG. 1, showing the tool preventing/mitigating fall-back sand from reaching the ESP during shutdown of the ESP.

String 10 includes production tubing 12, downhole tool 100, ESP 14, protector 16, and motor 18 for driving ESP 14. These components are strung together in a formation for production, e.g., of oil, gas and/or water, from within formation 20. In FIG. 1, the flow arrows indicate operation of ESP 14 to receive fluids in from formation 20 then drive through production tubing 12 and downhole tool 100 to the surface 22. As shown in FIG. 2, when ESP 14 stops pumping, fall-back sand 24 in the production tubing 12 above downhole tool 100 recedes toward the ESP 14, but is mitigated or prevented from reaching ESP 14 by downhole tool 100.

Figure 3:
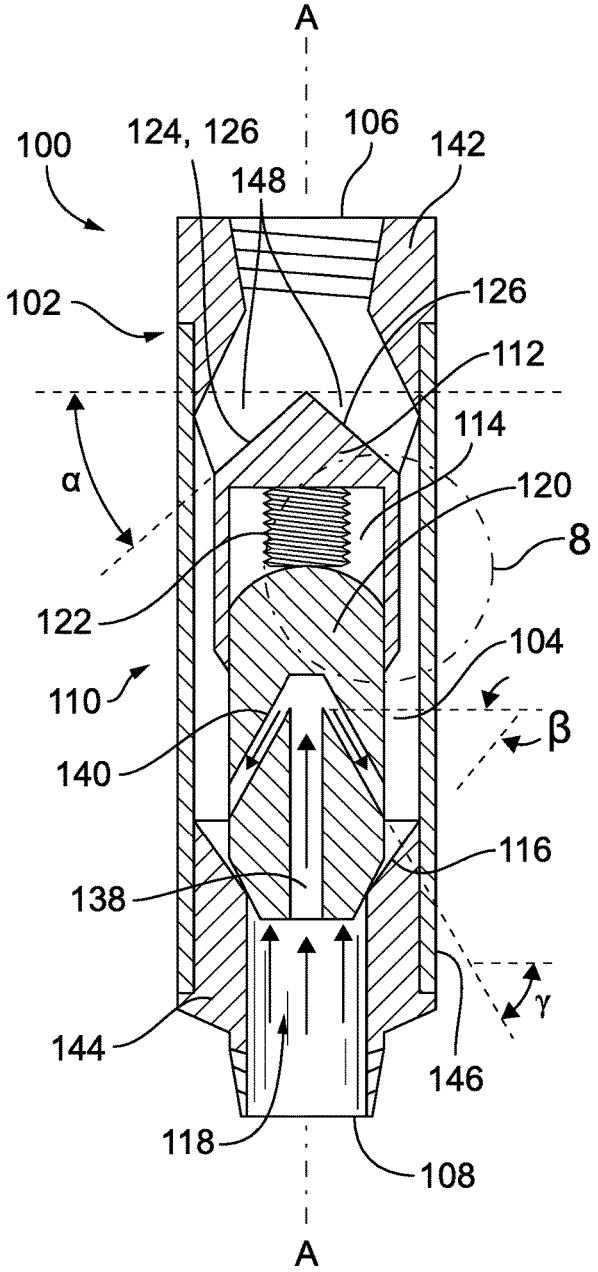
FIG. 3 is a schematic cross-sectional elevation view of the downhole tool of FIG. 1, showing the valve poppet in the closed position with flow arrows indicating the flow during opening of the poppet valve and just prior to establishment of a full flow condition.

With reference now to FIG. 3, downhole tool 100 is configured for sand fall-back prevention/prevention as described above. Downhole tool 100 includes a housing 102 defining a flow path 104 therethrough in an axial direction, e.g. generally along axis A, from an upper opening 106 to a lower opening 108. Depending on the direction of flow, upper opening 106 may be an inlet or an outlet, and the same can be said for lower opening 108. Those skilled in the art will readily appreciate that while axis A is oriented vertically, and while upper and lower openings 106 and 108 are designated as upper and lower as oriented in FIGS. 3-7, other orientations are possible including horizontal or oblique angles for axis A, and that the upper opening 106 need not necessarily be above lower opening 108 with respect to the direction of gravity. Upper opening 106 is closer than lower opening 108 in terms of flow reaching surface 22, shown in FIG. 1, regardless of the orientation of downhole tool 100.

A poppet valve 110 is mounted within the housing. The poppet valve 110 includes an upper member 112 defining an upper chamber 114 mounted in the flow path 104 so that flow through the flow path 104 flows around the upper member 112. A valve seat 116 is mounted in the flow path 104 with an opening 118 therethrough. A valve poppet 120 is mounted for longitudinal movement, e.g., in the direction of axis A, within the flow path 104 between a closed position, shown in FIG. 3, in which the valve poppet 120 seats against the valve seat 116 to block flow through the flow path 104, and an open position, shown in FIG. 4, in which the valve poppet 120 is spaced apart from the valve seat 116 to permit flow through the flow path 104.

Figure 4:
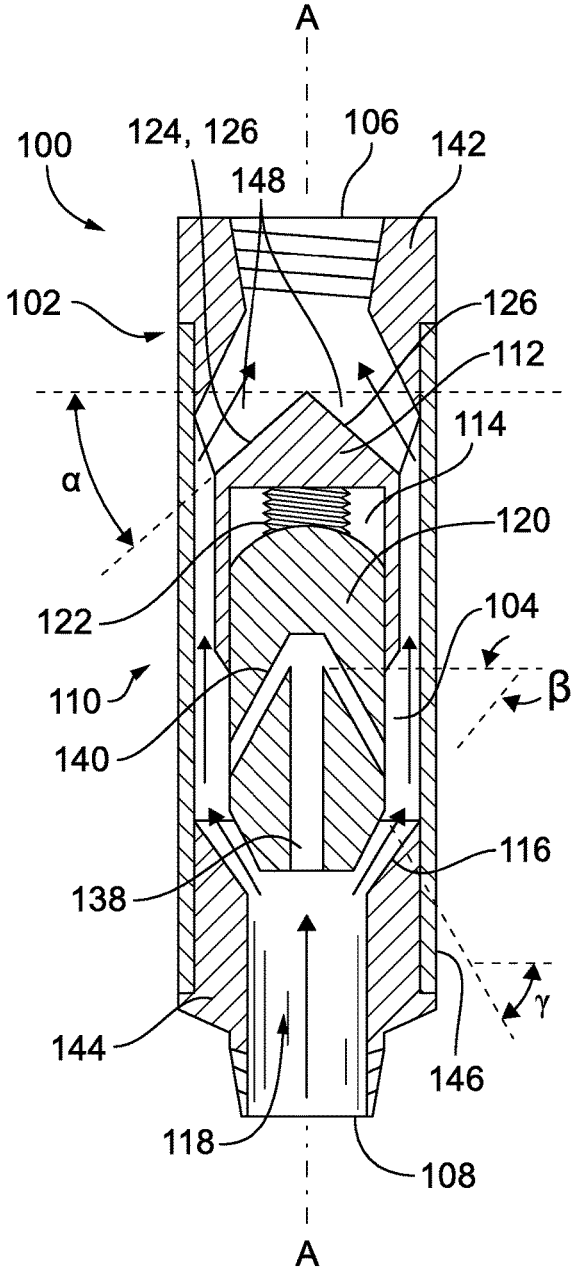
FIG. 4 is a schematic cross-sectional elevation view of the downhole tool of FIG. 1, showing the valve poppet in the open position, flowing as during production with a full flow condition.

In both the open and closed positions, as shown in FIGS. 4 and 3, respectively, the valve poppet 120 remains at least partially within the upper chamber 114 so that the upper chamber 114 is always enclosed to prevent/mitigate accumulation of fall-back sand above the valve poppet 120. A biasing member 122 is seated in the upper chamber 114 biasing the valve poppet 120 toward the valve seat 116. The biasing member can be configured to provide either an opening or closing force sized/calibrated with respect to fluid properties, slurry characteristics and flow conditions for moving the valve poppet 120 from the open/closed position to the closed/opened position. Biasing member 122 may be used to eliminate the need for gravitational forces assisting valve closure, e.g., in horizontal or deviated wells.

The upper member 112 includes an upper surface 124 with at least one angled portion 126 that is angled, e.g. at angle $\alpha$ below the level dashed line in FIG. 3, to resist accumulation of sand on the upper surface. For example angle $\alpha$ can be greater than the angle of repose, e.g. 45° of the fall-back sand and/or debris expected to be present in downhole tool 100.

Figure 8:
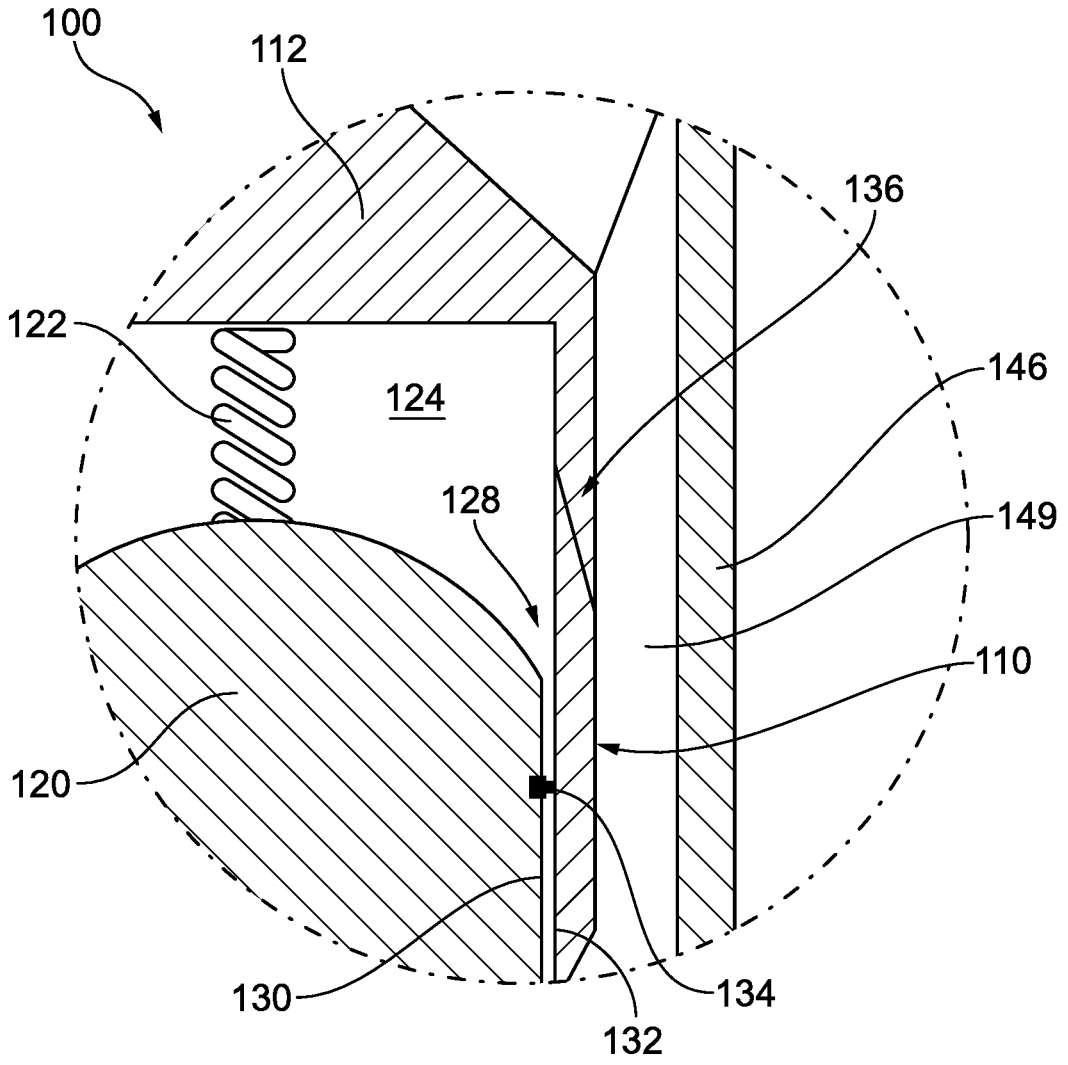
FIG. 8 is a schematic cross-sectional elevation view of a portion of the downhole tool of FIG. 1, showing the weep hole and wiper seal features of the valve that assist in enabling and protecting the upper movement of the valve's poppet.

As shown in FIG. 8, the valve poppet 120 is narrower than the upper chamber 124, and there is therefore a gap 128 to allow movement of the valve poppet 120 without resistance from fall-back sand or debris. Valve poppet 120 includes an axially oriented perimeter surface 130 matched in shape, e.g., cylindrical, with an axially oriented interior surface 132 of the upper chamber 124. A wiper seal 134 engages between the valve poppet 120 and the upper member. The wiper seal 134 may be configured to allow passage of fluid while inhibiting passage of sand or debris, to keep upper chamber 124 and gap 128 clear of sand or debris. While only one wiper seal 134 is shown, those skilled in the art will readily appreciate that any suitable number of wiper seals can be used, or other sealing mechanisms may be employed to achieve the same result of restricting debris passage while allowing liquid to seep across the sealing interface. A weep hole 136 can be defined through the upper member 112 from a space outside the upper chamber 124 to a space inside the upper chamber 124. The weep hole 136 is configured to equalize pressure between the flow space outside the upper chamber 124 with the cavity inside the upper chamber 124. A filter material can be included within the weep hole 136 to assist with preventing sand/debris from entering the upper chamber 124. Upper chamber 124 can be lengthened to any suitable length along valve poppet 120 for a given application, as the length helps prevent debris migration into upper chamber 124.

With reference again to FIG. 4, the valve seat 116 is defined by an angular surface, angled at angle $\beta$ below horizontal as oriented in FIG. 4. This encourages wedging of sand during closing of the valve poppet 120 against the valve seat 116. The angle $\beta$ also serves to limit restrictive forces while opening the poppet valve 110. A poppet channel 138 is defined through the valve poppet 120 for limited fluid communication through the flow path 104 with the valve poppet 120 in the closed position. The poppet channel 138 can have a flow area equal to one-half of that through the flow path 104 with poppet valve 120 in the open position, or greater. The poppet channel 138 can include one or more tributaries 140, each with an opening on the peripheral surface 130 of the poppet valve 120. Each of the tributaries 140 of the poppet channel 138 is directed downward toward the valve seat 116 for initiating a buoyancy change in sand seated between the valve seat 116 and the valve poppet 120 prior to the valve poppet 120 moving from the closed position to the open position. This type of flow is indicated in FIG. 3 with flow arrows. Each tributary 140 of the poppet channel can be defined along a tributary axis angled downward equal to an angle $\gamma$, e.g., or more than 45° from level. This angle $\gamma$ mitigates sand migrating upward through the channel tributary 140. Housing 102 includes a head 142 including the upper member 112 and upper opening 106. When excessive sand is present, the angle $\gamma$ and small channel diameter can prevent a constant flow of sand slurry in the reverse direction thereby creating a plug effect.

Housing 102 also includes a base 144 including the lower opening 108 and the valve seat 116. Hosing 102 further includes a housing body 146 mounted to the head 142 and base 144, spacing the head 142 and base 144 apart axially. Flow path 104 includes upper opening 106, passages 148 through head 142, the space 149 between housing body 146 and poppet valve 110 (as shown in FIG. 8), the space between valve poppet 120 and valve seat 106, opening 118 through valve seat 116, and lower opening 108. Head 142 and base 144 can include standard external upset end (EUE) connections for ease of installation of downhole tool 100 in a production tubing string above an ESP. Multiple downhole tools 100 an be strung together for cumulative effect and redundancy. Surfaces of head 142 may be coated or hardened to help mitigate erosion. The flow area can be slightly larger than the passageway of an ESP pump head with shaft coupling installed. Tool 100 may have multiple sizes to reflect a like ESP pump head passage way with shaft coupling installed.

Figure 5:
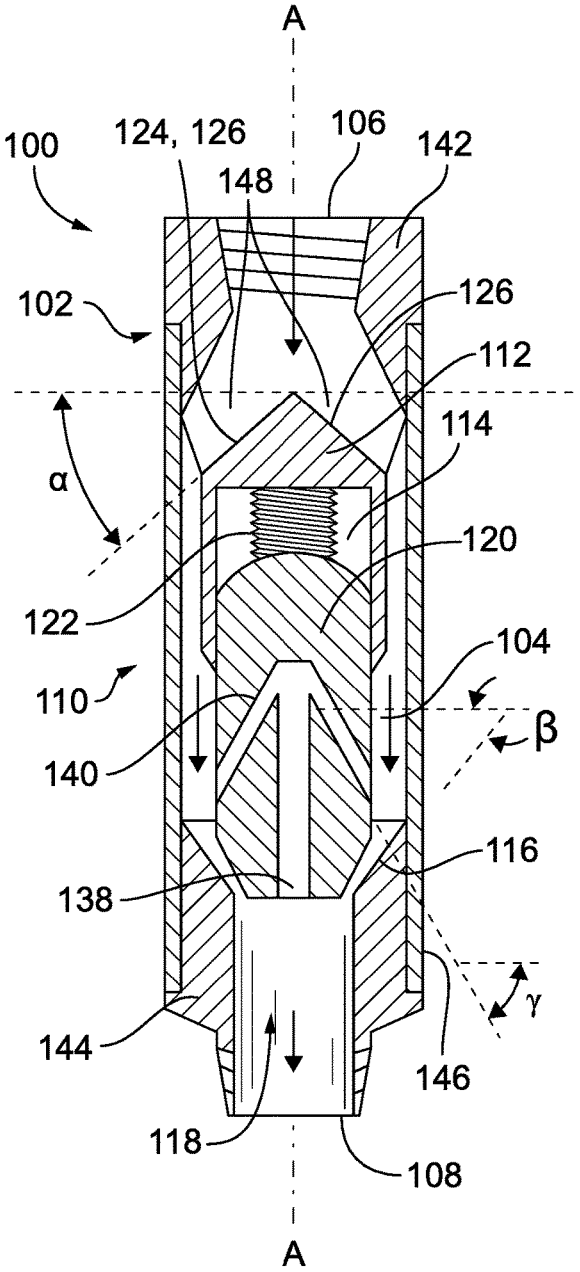
FIG. 5 is a schematic cross-sectional elevation view of the downhole tool of FIG. 1, showing the valve poppet closing immediately after powering down the ESP thereby inducing a reverse flow condition in the production tubing and valve.
Figure 6:
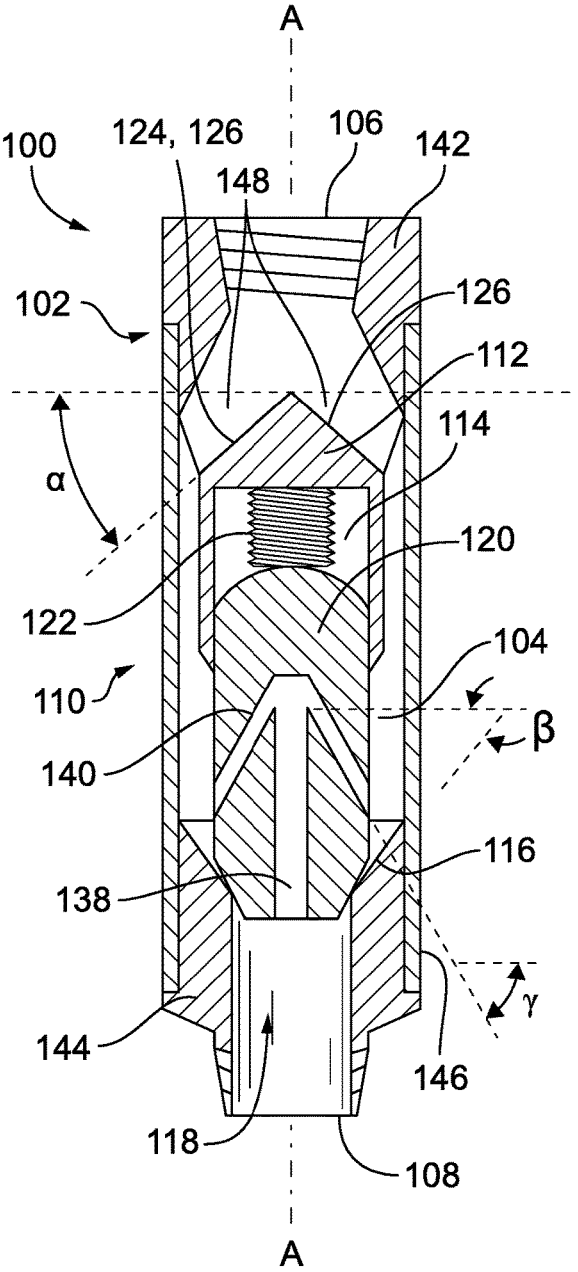
FIG. 6 is a schematic cross-sectional elevation view of the downhole tool of FIG. 1, showing the valve poppet in the closed position restricting/mitigating sand fall-back toward the ESP.

A method of reducing fall-back sand reaching an electrical submersible pump (ESP) includes holding a valve poppet, e.g., valve poppet 120, in an open position by operating an ESP, e.g., ESP 14, to drive flow through a flow path, e.g. flow path 114, past the valve poppet, as shown in FIG. 4, where the flow arrows indicate flow with the valve poppet in an open and flowing position. The method also includes moving the valve poppet into a closed position blocking the flow path by reducing flow from the ESP. FIG. 5 shows the valve poppet 120 moving to the closed position, wherein the flow arrows indicate back flow during shut down of ESP 14. In the closed position of poppet valve 120, shown in FIG. 6, valve poppet 120 restricts sand at the valve seat interface, thereby causing sand accumulation alongside the valve poppet 120, within the tributaries 140 and throughout the normal downstream flow path(s) of flow path 104, passages 148, and upper opening 106 while the valve poppet is in the closed position. In the closed position, back flow can be allowed thorough a poppet channel, e.g., poppet channel 138, defined through the valve poppet. This can allow for flow of chemical treatments for ESP from the surface during shutdown, for example.

Figure 7:
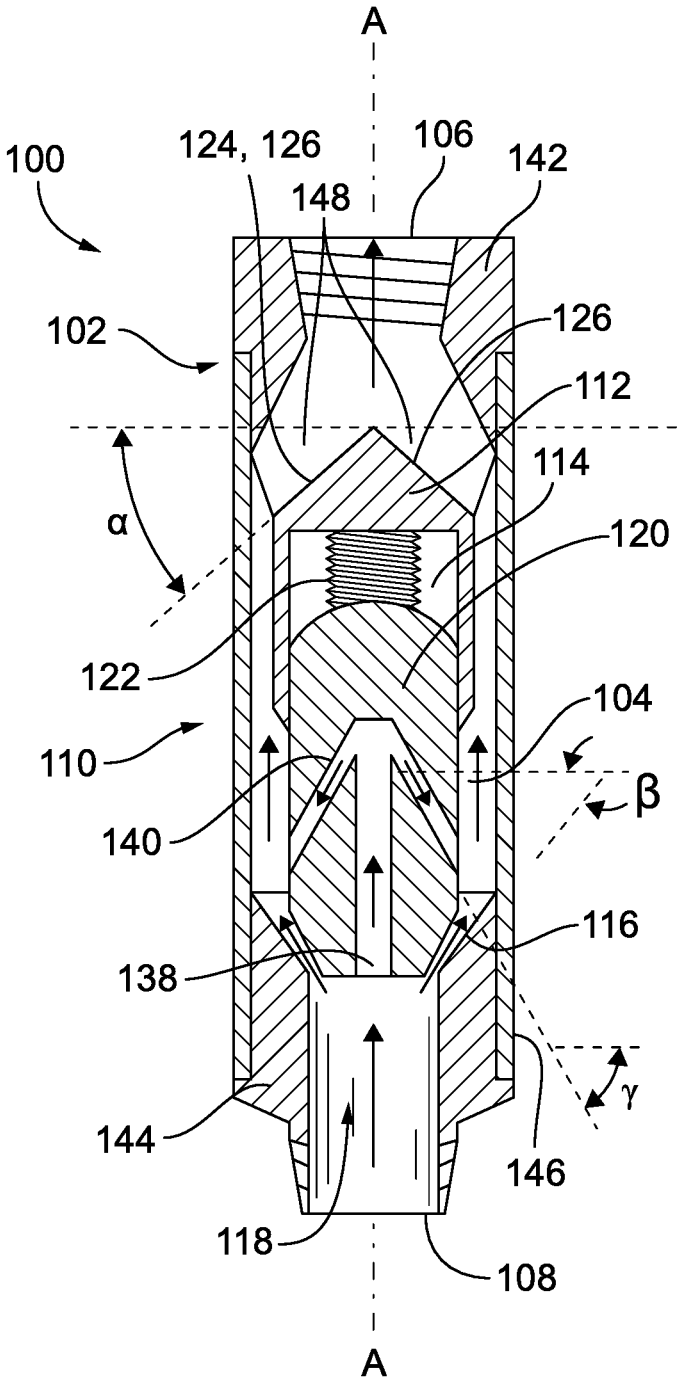
FIG. 7 is a schematic cross-sectional elevation view of the downhole tool of FIG. 1, showing the valve poppet re-opening while sand is restrained above the lower opening of the downhole tool.

Referring now to FIG. 3, initiating movement of the valve poppet from the closed position to an open position can be done by directing flow through a tributary, e.g. tributary 140, of the poppet channel defined through the valve poppet. This flow through the tributary is directed at sand accumulated between the valve poppet and an adjacent valve seat, e.g. valve seat 116. Thereafter, as ESP increases the flow pressure, the valve poppet overcomes the biasing member, e.g., biasing member 122, to move to the open position as shown in FIG. 7. This discharges accumulated fall-back sand from a tool, e.g., downhole tool 100, in an upward direction toward the surface 22 as indicated by the flow arrows in FIG. 7.

Accordingly, as set forth above, the embodiments disclosed herein may be implemented in a number of ways. For example, in general, in one aspect, the disclosed embodiments relate to a downhole tool for sand fall-back prevention. The downhole tool comprises, among other things, a housing defining a flow path therethrough in an axial direction from an upper opening to a lower opening. A poppet valve is mounted within the housing. The poppet valve includes an upper member defining an upper chamber mounted in the flow path so that flow through the flow path flows around the upper member, and a valve seat mounted in the flow path with an opening therethrough. A valve poppet is mounted for longitudinal movement within the flow path between a closed position in which the valve poppet seats against the valve seat to block flow through the flow path and an open position in which the valve poppet is spaced apart from the valve seat to permit flow through the flow path.

In general, in another aspect, the disclosed embodiments related to a method of reducing fall-back sand reaching an electrical submersible pump (ESP). The method comprises, among other things, holding a valve poppet in an open position by operating an ESP to drive flow through a flow path past the valve poppet, moving the valve poppet into a closed position blocking the flow path by reducing flow from the ESP, blocking sand through the flow path with the valve poppet, and preventing accumulation of sand above, e.g., directly above, the valve poppet while the valve poppet is in the closed position.

In accordance with any of the foregoing embodiments, in both the open and closed positions, the valve poppet can be at least partially within the upper chamber so that the upper chamber is always enclosed to prevent accumulation of fall-back sand above the valve poppet.

In accordance with any of the foregoing embodiments, a biasing member can be seated in the upper chamber biasing the valve poppet toward the valve seat.

In accordance with any of the foregoing embodiments, the upper member can include an upper surface with at least one angled portion that is angled to resist accumulation of sand on the upper surface.

In accordance with any of the foregoing embodiments, the valve poppet can be narrower than the upper chamber to allow movement of the valve poppet without resistance from fall-back sand or debris.

In accordance with any of the foregoing embodiments, the valve poppet can include an axially oriented perimeter surface matched in shape with an axially oriented interior surface of the upper chamber.

In accordance with any of the foregoing embodiments, a wiper seal or similar functioning seal can engage between the valve poppet and the upper member, wherein the seal is configured to allow passage of fluid while inhibiting passage of sand or debris.

In accordance with any of the foregoing embodiments, a weep hole can be defined through the upper member from a space outside the upper chamber to a space inside the upper chamber, wherein the weep hole is configured to equalize pressure between the space outside the upper chamber with the space inside the upper chamber. A filter material can be included within the weep hole.

In accordance with any of the foregoing embodiments, the valve seat can be defined by an angular surface configured to encourage wedging of sand during closing of the valve poppet against the valve seat.

In accordance with any of the foregoing embodiments, a poppet channel can be defined through the valve poppet for limited fluid communication through the flow path with the valve poppet in the closed position. The poppet channel can have a flow area equal to one-half of that through the flow path or greater. The poppet channel can include a tributary with an opening on a peripheral surface of the poppet valve, wherein the tributary of the poppet channel is directed downward toward the valve seat for initiating a buoyancy change in sand seated between the valve seat and the valve poppet prior to the valve poppet moving from the closed position to the open position. The tributary of the poppet channel can be defined along a tributary axis angled downward, e.g., 45° from level.

In accordance with any of the foregoing embodiments, the housing can include a head including the upper member and upper opening, a base including the lower opening and the valve seat, and a housing body mounted to the head and base, spacing the head and base apart axially.

In accordance with any of the foregoing embodiments, back flow can be allowed thorough a poppet channel defined through the valve poppet.

In accordance with any of the foregoing embodiments, initiating movement of the valve poppet from the closed position to an open position can be done by directing flow through a tributary of a poppet channel defined through the valve poppet, wherein the flow through the tributary is directed at sand accumulated between the valve poppet and an adjacent valve seat.

In accordance with any of the foregoing embodiments, increasing flow through the ESP can move the valve poppet into an open position for flow through the flow path, and accumulated fall-back sand can be discharged from a tool including the valve poppet in an upward direction.

The methods and systems of the present disclosure, as described above and shown in the drawings, provide for reduction or prevention of fall-back sand reaching an ESP with superior properties including accommodation for desirable back flow, extended useable life, and improved reliability relative to traditional systems and methods. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A downhole tool for sand fall-back prevention comprising: a housing defining a flow path therethrough in an axial direction from an upper opening to a lower opening; a poppet valve mounted within the housing, wherein the poppet valve includes: an upper member defining an upper chamber mounted in the flow path so that flow through the flow path flows around the upper member; a valve seat mounted in the flow path with an opening therethrough; and a valve poppet mounted for longitudinal movement within the flow path between a closed position in which the valve poppet seats against the valve seat to block flow through the flow path and an open position in which the valve poppet is spaced apart from the valve seat to permit flow through the flow path, wherein the valve poppet is narrower than the upper chamber to allow movement of the valve poppet without resistance from fall-back sand or debris.

2. A downhole tool as recited in claim 1, wherein in both the open and closed positions, the valve poppet is at least partially within the upper chamber so that the upper chamber is always enclosed to prevent accumulation of fall-back sand above the valve poppet.

3. A downhole tool of claim 1, wherein a biasing member is seated in the upper chamber biasing the valve poppet toward the valve seat.

4. A downhole tool as recited in claim 3, wherein the biasing member is configured to provide an opening force for moving the valve poppet from an open/closed position to a closed/open position.

5. A downhole tool of claim 1, wherein the upper member includes an upper surface with at least one angled portion that is angled to resist accumulation of sand on the upper surface.

6. A downhole tool of claim 1, wherein the valve seat is defined by an angular surface configured to encourage wedging of sand during closing of the valve poppet against the valve seat.

7. A downhole tool of claim 1, wherein the housing includes: a head including the upper member and upper opening; a base including the lower opening and the valve seat; and a housing body mounted to the head and base, spacing the head and base apart axially.

8. A downhole tool for sand fall-back prevention comprising: a housing defining a flow path therethrough in an axial direction from an upper opening to a lower opening; a poppet valve mounted within the housing, wherein the poppet valve includes: an upper member defining an upper chamber mounted in the flow path so that flow through the flow path flows around the upper member; a valve seat mounted in the flow path with an opening therethrough; and a valve poppet mounted for longitudinal movement within the flow path between a closed position in which the valve poppet seats against the valve seat to block flow through the flow path and an open position in which the valve poppet is spaced apart from the valve seat to permit flow through the flow path, wherein the valve poppet includes an axially oriented perimeter surface matched in shape with an axially oriented interior surface of the upper chamber.

9. A downhole tool for sand fall-back prevention comprising: a housing defining a flow path therethrough in an axial direction from an upper opening to a lower opening; a poppet valve mounted within the housing, wherein the poppet valve includes: an upper member defining an upper chamber mounted in the flow path so that flow through the flow path flows around the upper member; a valve seat mounted in the flow path with an opening therethrough; and a valve poppet mounted for longitudinal movement within the flow path between a closed position in which the valve poppet seats against the valve seat to block flow through the flow path and an open position in which the valve poppet is spaced apart from the valve seat to permit flow through the flow path, wherein a seal engages between the valve poppet and the upper member, wherein the seal is configured to allow passage of fluid while inhibiting passage of sand or debris.

10. A downhole tool for sand fall-back prevention comprising: a housing defining a flow path therethrough in an axial direction from an upper opening to a lower opening; a poppet valve mounted within the housing, wherein the poppet valve includes: an upper member defining an upper chamber mounted in the flow path so that flow through the flow path flows around the upper member; a valve seat mounted in the flow path with an opening therethrough; and a valve poppet mounted for longitudinal movement within the flow path between a closed position in which the valve poppet seats against the valve seat to block flow through the flow path and an open position in which the valve poppet is spaced apart from the valve seat to permit flow through the flow path, wherein a weep hole is defined through the upper member from a space outside the upper chamber to a space inside the upper chamber, wherein the weep hole is configured to equalize pressure between the space outside the upper chamber with the space inside the upper chamber.

11. A downhole tool as recited in claim 10, wherein a filter material is included within the weep hole.

12. A downhole tool for sand fall-back prevention comprising: a housing defining a flow path therethrough in an axial direction from an upper opening to a lower opening; a poppet valve mounted within the housing, wherein the poppet valve includes: an upper member defining an upper chamber mounted in the flow path so that flow through the flow path flows around the upper member; a valve seat mounted in the flow path with an opening therethrough; and a valve poppet mounted for longitudinal movement within the flow path between a closed position in which the valve poppet seats against the valve seat to block flow through the flow path and an open position in which the valve poppet is spaced apart from the valve seat to permit flow through the flow path, wherein a poppet channel is defined through the valve poppet for limited fluid communication through the flow path with the valve poppet in the closed position.

13. A downhole tool as recited in claim 12, wherein the poppet channel has a flow area equal to one-half of that through the flow path or greater.

14. A downhole tool as recited in claim 12, wherein the poppet channel includes a tributary with an opening on a peripheral surface of the poppet valve, wherein the tributary of the poppet channel is directed downward toward the valve seat for initiating a buoyancy change in sand seated between the valve seat and the valve poppet prior to the valve poppet moving from the closed position to the open position.

15. A downhole tool as recited in claim 14, wherein the tributary of the poppet channel is defined along a tributary axis angled downward equal to or more than 45.degree. from level.

16. A method of reducing fall-back sand reaching an electrical submersible pump (ESP) comprising: holding a valve poppet in an open position by operating an ESP to drive flow through a flow path past the valve poppet; moving the valve poppet into a closed position blocking the flow path by reducing flow from the ESP; blocking sand through the flow path with the valve poppet; and preventing accumulation of sand above the valve poppet while the valve poppet is in the closed position, and allowing back flow thorough a poppet channel defined through the valve poppet.

17. A method of claim 16, further comprising: increasing flow through the ESP to move the valve poppet into an open position for flow through the flow path; and discharging accumulated fall-back sand from a tool including the valve poppet in an upward direction.

18. A method of reducing fall-back sand reaching an electrical submersible pump (ESP) comprising: holding a valve poppet in an open position by operating an ESP to drive flow through a flow path past the valve poppet moving the valve poppet into a closed position blocking the flow path by reducing flow from the ESP; blocking sand through the flow path with the valve poppet and preventing accumulation of sand above the valve poppet while the valve poppet is in the closed position and initiating movement of the valve poppet from the closed position to an open position by directing flow through a tributary of a poppet channel defined through the valve poppet, wherein the flow through the tributary is directed at sand accumulated between the valve poppet and an adjacent valve seat.

* * * * *